US005997809A

United States Patent [19]

Smith et al.

[11] Patent Number: 5,997,809

[45] Date of Patent: Dec. 7, 1999

[54] ALLOYS FOR HIGH TEMPERATURE SERVICE IN AGGRESSIVE ENVIRONMENTS

[75] Inventors: Gaylord Darrell Smith, Huntington, W. Va.; Norman Farr, Hereford, United Kingdom; Brian Allen Baker, Kitts Hill, Ohio

[73] Assignee: Inco Alloys International, Inc., Huntington, W. Va.

[21] Appl. No.: 09/207,240

[22] Filed: Dec. 8, 1998

[51] Int. Cl.[6] ..... C22C 19/05

[52] U.S. Cl. ..... 420/443; 420/447

[58] Field of Search ..... 420/443, 447

[56] References Cited

U.S. PATENT DOCUMENTS 4,312,682 1/1982 Herchenroeder ..... 148/2

4,762,681 8/1988 Tassen et al. ..... 420/443

4,882,125 11/1989 Smith et al. ..... 420/443

FOREIGN PATENT DOCUMENTS 2065464 10/1992 Canada .

2179214 1/1997 Canada .

549286 6/1995 European Pat. Off. .

59-85836 5/1984 Japan .

*Primary Examiner*—Deborah Yee

*Attorney, Agent, or Firm*—Robert F. Dropkin, Esq.

[57] ABSTRACT

An alloy resistant to carburization and high temperature oxidation. The alloy consists essentially of, by weight percent, 27 to 35 chromium, 0 to 7 iron, about 3 to 4.4 aluminum, 0 to 0.4 titanium, 0.2 to 3 niobium, 0.12 to 0.5 carbon, 0 to 0.05 zirconium, 0.002 to 0.05 total cerium and yttrium, 0 to I manganese, 0 to I silicon, 0 to 0.5 calcium plus magnesium, 0 to 0.1 boron and balance nickel plus incidental impurities.

10 Claims, 5 Drawing Sheets

ALLOYS FOR HIGH TEMPERATURE SERVICE IN AGGRESSIVE ENVIRONMENTS

FIELD OF THE INVENTION

This invention relates specifically to nickel-chromium alloys having resistance to carburization and high temperature oxidation.

BACKGROUND OF THE INVENTION

Nickel-chromium alloys are known for their capability to afford various degrees of resistance to a myriad of both low temperature and high temperature corrosion environments. For this reason, these alloys are employed in a wide range of industrial and aerospace applications. Of particular utility is the use of nickel-chromium alloys in the thermal processing, chemical and petrochemical applications where high temperatures are essential for technical reasons and economy of operation. Such examples include furnace rollers in annealing furnaces and ceramic kilns, radiant tubes in heating furnaces, conveyor belts in sintering furnaces, muffles and retorts in furnaces and chemical process equipment, tubes for oxidizing titanium compounds to titanium dioxide paint pigment, thermocouple protection tubes and hardware for glass manufacture and glass verification of nuclear wastes.

By reason of their strength and corrosion resistance in such environments, alloys such as INCONEL® alloys 601, 617 and 690 (INCONEL is a trademark of Inco Alloys International, Inc.) and alloy 602CA are typically used in applications subject to high temperature oxidation. However, the trend towards increasing temperatures, more aggressive environments and the need for longer service life has stretched these alloys beyond their capabilities.

It is an object of this invention to provide an alloy having an improved combination of strength and general corrosion resistance for longer service lives than of existing commercial alloys.

It is a further object of this invention to provide an alloy with excellent carburization and oxidation resistance at elevated temperatures.

It is a further object of this invention to provide an alloy with excellent carburization and oxidation resistance under isothermal and cyclic conditions.

SUMMARY OF THE INVENTION

An alloy resistant to carburization and high temperature oxidation resistance. The alloy consists essentially of, by weight percent, 27 to 35 chromium, 0 to 7 iron, 3 to 4.4 aluminum, 0 to 0.4 titanium, 0.2 to 3 niobium, 0.12 to 0.5 carbon, 0 to 0.05 zirconium, 0.002 to 0.05 total cerium and yttrium, 0 to I manganese, 0 to I silicon, 0 to 0.5 calcium plus magnesium, 0 to 0.1 boron and balance nickel plus incidental impurities.

DESCRIPTION OF PREFERRED EMBODIMENT

It has been discovered that the range of nickel-chromium-aluminum alloys, by virtue of their protective scales and their intrinsic strength, can meet stringent material requirements beyond those of currently available commercial alloys. Specifically, an alloy range containing controlled percentages of nickel, chromium, aluminum, columbium, iron, manganese, silicon, zirconium, magnesium, boron and cerium plus yrttrium provides an excellent combination of carburization and oxidation resistance at elevated temperatures, e.g., 982–1093° C. (1800–2000° F.) under isothermal and cyclic conditions. Furthermore, this alloy has good stress rupture and creep strength at such high temperatures, plus satisfactory tensile strength and ductility. In this case, high temperature stress rupture strength is defined as greater than about 100 hours or more at a stress of 13.8 MPa (2 ksi) at 982° C. (1800° F.). Furthermore, this specification describes all compositions in weight percent, unless specifically expressed otherwise.

The alloy achieves longer service life by providing an "alloy reservoir" of chromium plus aluminum in an austenitic nickel matrix to maintain a highly protective scale under severe high temperature, corrosive conditions. This alloy reservoir restores protection when spallation or excessive rates of scale formation occurs. Scale adhesion under the most cyclic of conditions is ensured by the addition of at least 20 ppm of cerium plus yttrium and optionally zirconium. Intermediate strength is achieved through precipitation of gamma prime ($Ni_3Al$) as defined by 15 to 20 mole percent of $Ni_3Al$ at 800° C. (1472° F.) in this range of alloys. Furthermore, high temperature strength is provided through formation of 2 to 8 mole percent $Cr_7C_3$ plus $Cr_{23}C_6$. High temperature strength and fabricability are further enhanced by the addition of controlled amounts of zirconium plus boron to strengthen grain boundaries.

In carrying this range of alloys into practice, it is preferred that the chromium content not exceed 35% in order not to detract from high temperature tensile ductility and stress rupture strength. The chromium content can extend down to about 27% with only a minor loss of corrosion resistance. Increasing minimum chromium to 29 or 30% maximizes corrosion resistance. Furthermore, chromium plays a dual role in this alloy range by contributing to the protective nature of the $Cr_2$ $0_3$-$Al_2$03 scale and by forming $Cr_7C_3$and $Cr_{23}CsC_6$to strengthen the alloy at high temperatures. For these reasons, chromium should be present in the alloy in the optimal range of 29 to 34%.

Figure 1:
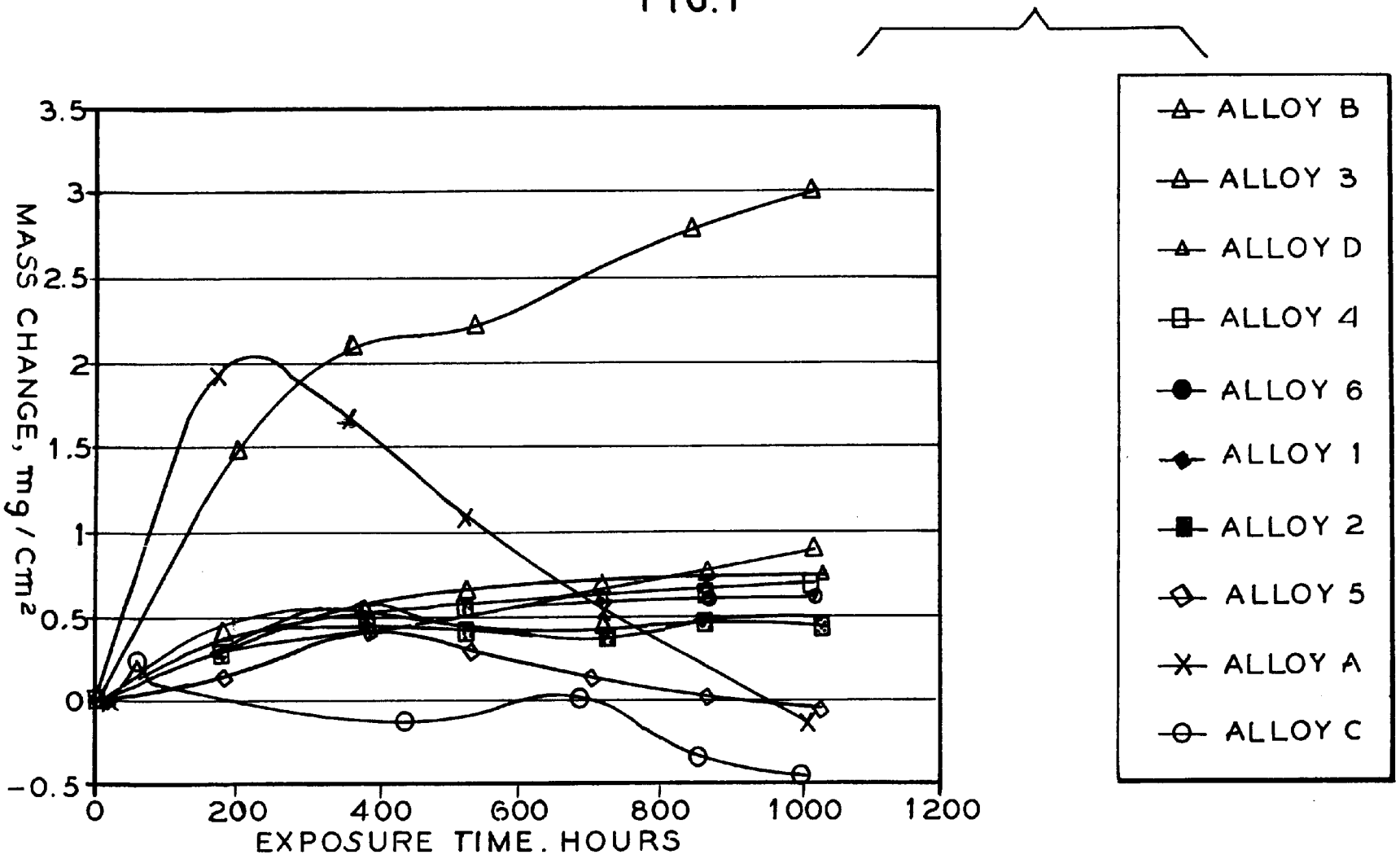
FIG. 1 compares mass change of the alloys in air −5% $H_2O$ at a temperature of 1000° C.

Aluminum markedly improves carburization and oxidation resistance. It is essential that it be present in amounts of at least 3%. High levels of aluminum detract from toughness after exposure at intermediate temperatures and must be limited to 4.4% to ensure adequate toughness during service life. Furthermore, aluminum levels above 4.4% adversely impact hot workability. As in the case with chromium, aluminum percentages below 3% fail to develop the protective scale required for long service life. This is exemplified by the oxidation data presented at 1100° C. (2000° F.) for the commercial alloys cited in FIG. 1.

The combination of chromium and aluminum is critical for formation of the stable, highly protective $Cr_2O_3$—$Al_2$0$_3$ scale. A $Cr_2$0$_3$ scale, even at 30% chromium in the alloy, does not sufficiently protect the alloy at high temperatures due to vaporization of the scale as $CrO_3$ and subspecies of $Cr_2O_3$—alloy C in FIG. 1 exemplifies this. When the alloy contains less than about 3% aluminum, the protective scale fails to prevent internal oxidation of the aluminum—alloy B in FIG. 1 exemplifies this. Internal oxidation of aluminum over a wide range of partial pressures of oxygen, carbon and temperature can be avoided by controlling the combination of chromium and aluminum to 30 to 35% chromium and 3 to 4% aluminum. This is also important in ensuring self-healing in the event of mechanical damage to the scale.

Iron may be present in the range of about up to 7%. It is postulated that iron segregates at the grain boundaries such that carbide morphology is adversely affected and corrosion resistance is impaired. Most advantageously, iron should not exceed 5.5%. But it does lend to the use of ferrochromium. Thus, there is an economic benefit for allowing for the presence of iron.

Niobium, in the amount of 0.2 to 3%/, contributes to the formation of a stable (Ti, Cb) (C, N) which aids high temperature strength and in small concentrations has been found to enhance oxidation resistance. Excess niobium holdover can contribute to phase instability and over-aging. Titanium, in the range of 0 to 0.4%, acts similarly. Unfortunately, titanium levels above 0.4% decrease the alloy's mechanical properties.

Optionally, zirconium between 0.001 and 0.5% enhances scale adhesion and retards cation diffusion through the protective scale for longer service life. Furthermore, this element acts as a carbonitride former.

Carbon at 0.12% is essential in achieving minimum stress rupture life, while carbon contents in excess of 0.5% markedly reduce stress rupture life and lead to intermediate temperature reduction in ductility.

Boron is useful as a deoxidizer up to about 0.1% and can be utilized to advantage for hot workability.

Cerium plus yttrium between 20 and 500 ppm play a significant role in ensuring scale adhesion under cyclic conditions. Most advantageously, total cerium and yttrium is at least 40 ppm for excellent scale adhesion. Furthermore, limiting total cerium and yttrium to 400 ppm improves fabricability of the alloy. Optionally, it is possible to add cerium in the form of a misch metal. This introduces lanthanum and other rare earths as incidental impurities. These rare earths can have a small beneficial effect on oxidation resistance.

Manganese, used as a sulfur scavenger, is detrimental to high temperature oxidation resistance if present in amounts exceeding about 1%. Silicon in excess of 1% can lead to embrittling grain boundary phases, while minor amounts can lead to improved oxidation and carburization resistance. Silicon should be held to less than 0.5% however, in order to achieve maximum grain boundary strength.

Nickel and incidental impurities form the balance of the alloy. Advantageously, 52 to 67% nickel form a stable authentic matrix. Maintaining nickel at a minimum of 55% and chromium plus iron at less than 39% minimizes the formation of alpha-chromium to less than 8 mole percent at 800° C. (1472° F.), thus aiding maintenance of intermediate temperature tensile ductility.

Phosphorus and sulfur should be maintained at the lowest levels consistent with good melting practice. Calcium and magnesium (in addition to cerium) in quantities up to 0.5% serve to tie up sulfur. Most advantageously the alloy contains at least 0.002% calcium plus magnesium. Excess amounts of alkaline earth metal tend to decrease the alloy's strength properties.

Table 1 below summarizes "about" the advantageous ranges of the invention.

TABLE 1

| | Broad | Intermediate | Narrow |
|---|---|---|---|
| Ni | Bal.* | 52–67* | 55–65* |
| Cr | 27–35 | 28–34 | 29–34 |
| Fe | 0–7 | 0.5–6 | 1–5.5 |
| Al | 3–4.4 | 3–4.2 | 3–4 |
| Ti | 0–0.4 | 0.05–0.3 | 0.1–0.3 |
| Nb | 0.2–3 | 0.3–2.5 | 0.5–2 |
| C | 0.12–0.5 | 0.12–0.4 | 0.12–0.3 |
| Zr | 0–0.5 | 0.0002–0.3 | 0.001–0.2 |
| Y | ** | 0.001–0.045** | 0.0025–0.0250*** |
| Ce | ** | 0.001–0.045** | 0.0025–0.0250*** |
| Mn | 0–1 | 0–0.7 | 0–0.5 |
| Si | 0–1 | 0–0.7 | 0–0.5 |
| Ca + Mg | 0–0.5 | 0.001–0.1 | 0.002–0.05 |
| B | 0–0.1 | 0–0.05 | 0–0.01 |

*Plus Incidental Impurities
**Ce + Y = 0.002 to 0.05%
***Ce + Y = 0.005 to 0.04%

In respect to fabrication, vacuum melting, optionally followed by either electroslag or vacuum arc remelting, is recommended. Because of the composition of the alloy range of this patent application, a dual solution anneal is recommended to maximize solution of the elements—a single high temperature anneal may only serve to concentrate the aluminum as a low melting, brittle phase in the grain boundaries, whereas, an initial anneal in the range of 1100° C. (2012° F.) to 1150° C. (2102° F.) serves to diffuse the aluminum away from the grain boundary after which a higher temperature anneal can be used to maximize solution of all elements. Times for this dual step anneal can vary from 1 to 48 hours depending on ingot size and composition.

Following solution annealing, hot working can be conducted over the range of 982° C. (1800° F.) to 1150° C. (2102° F.). Intermediate and final anneals should be performed within the temperature range of about 1038° C. (1900° F.) to 1204° C. (2200° F.) depending on desired grain size. Times at temperature of 30 minutes to one hour usually arc adequate, but longer times are easily accommodated.

The alloy range is not intended to be used in the intermediate temperature range where age hardening can occur. However, the alloy can be age hardened in the temperature range of 621° C. (1150° F.) to 816° C. (1500° F.). Conventional double aging treatments may also be utilized.

The following heats illustrate the benefit achieved with this alloy. A series of six 22.7 kg (50 lb) heats (Alloys I through 6) was prepared using vacuum melting. The compositions are given in Table 2. Alloys A through D are examples of commercial alloys 601, 617, 690 and 602CA respectively to illustrate advantages of alloys 1 to 6.

TABLE 2

| | Nominal Composition | | | | | | | | | | | | | | |
|---|---|---|---|---|---|---|---|---|---|---|---|---|---|---|---|
| HEAT | C | Mn | Fe | Si | Ni | Cr | Al | Ti | Mg | Cb | Zr | N | Ce | Y | Other |
| 1 | 0.10 | 0.09 | 5.0 | 0.18 | 60.0 | 30.2 | 3.21 | 0.16 | 0.019 | 0.977 | 0.001 | 0.034 | 0.005 | 0.001 | |
| 2 | 0.15 | 0.10 | 4.4 | 0.11 | 60.3 | 30.4 | 3.26 | 0.15 | 0.017 | 0.972 | — | 0.034 | 0.010 | 0.002 | |
| 3 | 0.23 | 0.10 | 4.5 | 0.11 | 60.0 | 30.6 | 3.23 | 0.15 | 0.014 | 0.978 | — | 0.030 | 0.008 | 0.002 | |
| 4 | 0.16 | 0.10 | 4.5 | 0.12 | 60.1 | 30.5 | 3.27 | 0.15 | 0.012 | 0.970 | 0.089 | 0.030 | 0.011 | 0.002 | |
| 5 | 0.15 | 0.10 | 4.5 | 0.11 | 60.2 | 30.5 | 3.17 | 0.14 | 0.013 | 0.964 | 0.006 | 0.036 | 0.006 | 0.003 | |
| 6 | 0.23 | 0.09 | 4.3 | 0.12 | 61.2 | 30.5 | 3.17 | 0.15 | 0.010 | 0.046 | 0.089 | 0.022 | 0.001 | 0.019 | |
| A | 0.04 | 0.2 | 14 | 0.2 | 61.0 | 23.0 | 1.4 | 0.4 | — | — | — | 0.03 | — | — | |
| B | 0.09 | — | 1.0 | 0.1 | 52.0 | 22.0 | 1.2 | 0.4 | — | — | — | — | — | — | 9.5Mo,12.5Co |
| C | 0.01 | 0.1 | 9.0 | 0.1 | 62.0 | 28.0 | — | 0.2 | — | — | — | — | — | — | |
| D | 0.19 | 0.10 | 9.9 | 0.12 | 61.9 | 25.0 | 2.38 | 0.17 | 0.012 | — | 0.078 | 0.023 | — | 0.05 | |

Figure 2:
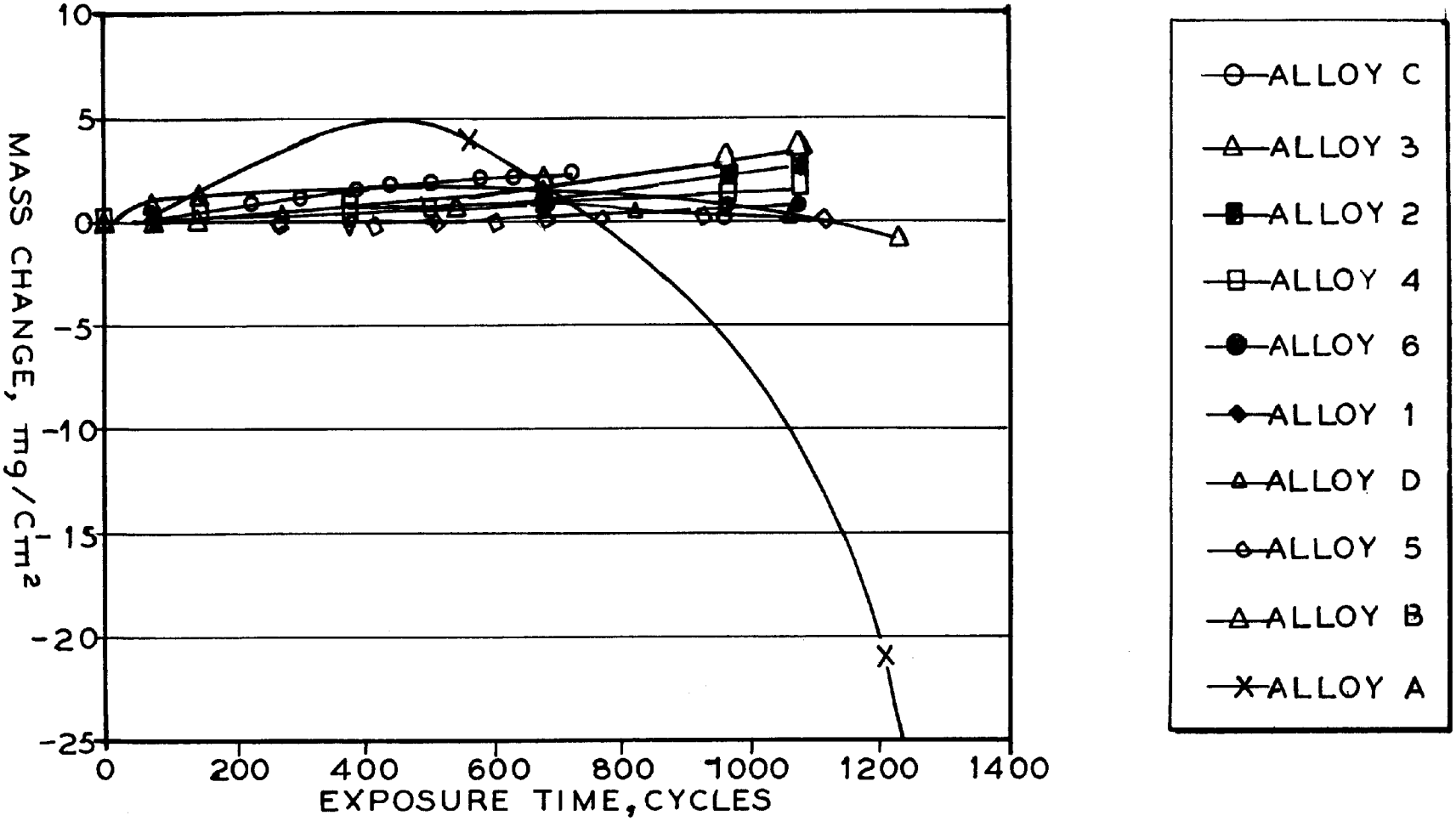
FIG. 2 compares mass change in air for the alloys cycled 15 minutes in and 5 minutes out at a temperature of 1100° C.

Alloys 1 through 6 were solution annealed 16 hours at 1150° C. (2102° F.) followed by 4 hours at 1200° C. (2192° F.) and then hot worked from a 1175° C. (2150° F.) furnace temperature. The 102 mm (4 in) square×length ingots were forged to 20.4 mm (0.8 in) diameter×length rod and given a final anneal at 1100° C. (2012° F.) for one hour followed by an air cool. Oxidation, carburization and cyclic oxidation pins [7.65 mm (0.3 in) diameter×19.1 mm (0.75 in)] were machined and cleaned with acetone. The oxidation pins were exposed for 1000 hours at 1000° C. (1832° F.) in air plus 5% water vapor with periodic removal from the electrically heated mullite furnace to establish mass change as a function of time. The results are plotted graphically in FIG. 1 along with results from some of the commercial alloys. Similarly, cyclic oxidation data are depicted in FIG. 2 for alloys 1 to 6 as well as for several of the commercial alloys. The cyclic oxidation testing was conducted in laboratory air with a cycle of 15 minutes in the furnace followed by 5 minutes in air. The test ran for 1200 cycles.

Figure 3:
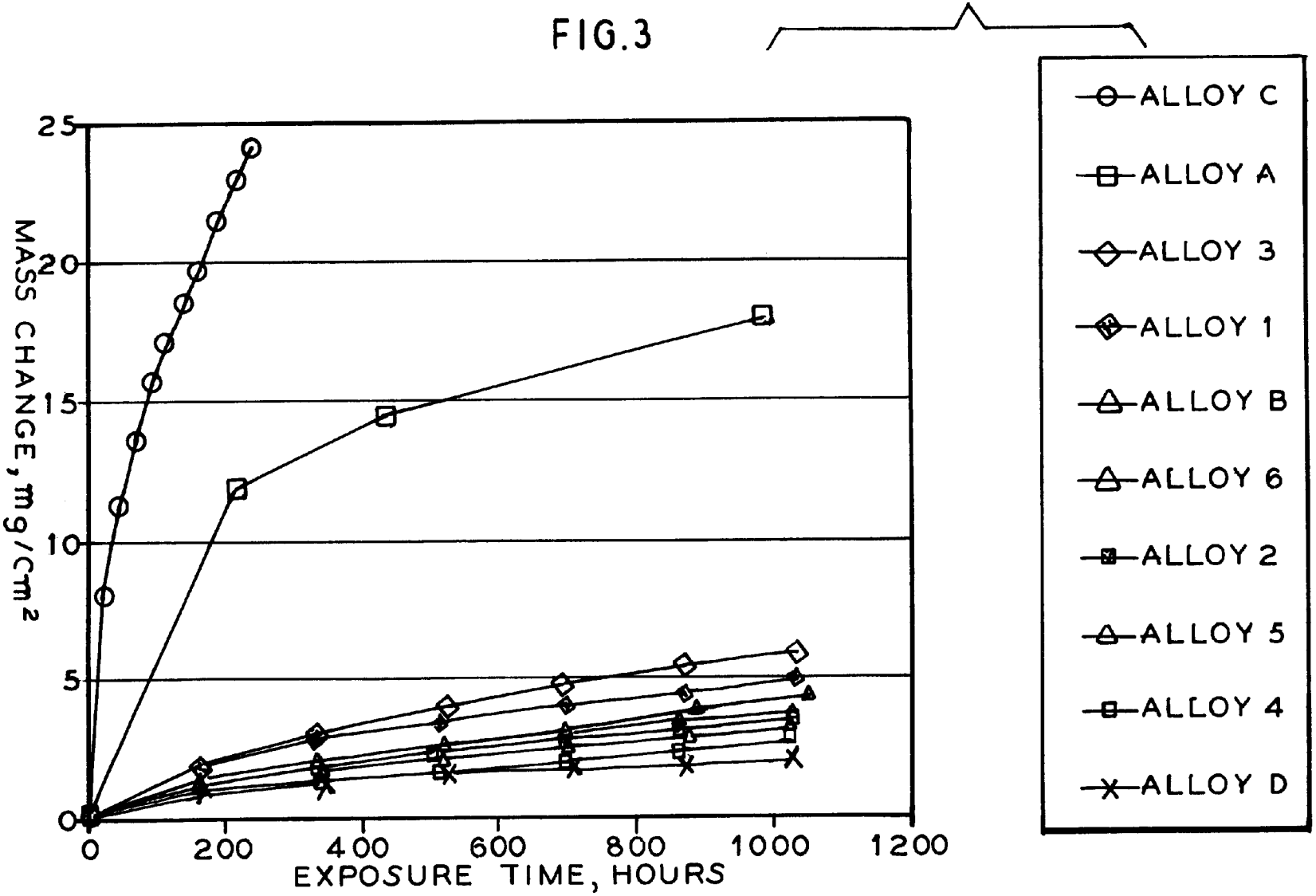
FIG. 3 compares mass change of the alloys in $H_2$ −1% $CH_4$ at a temperature of 1000° C.
Figure 4:
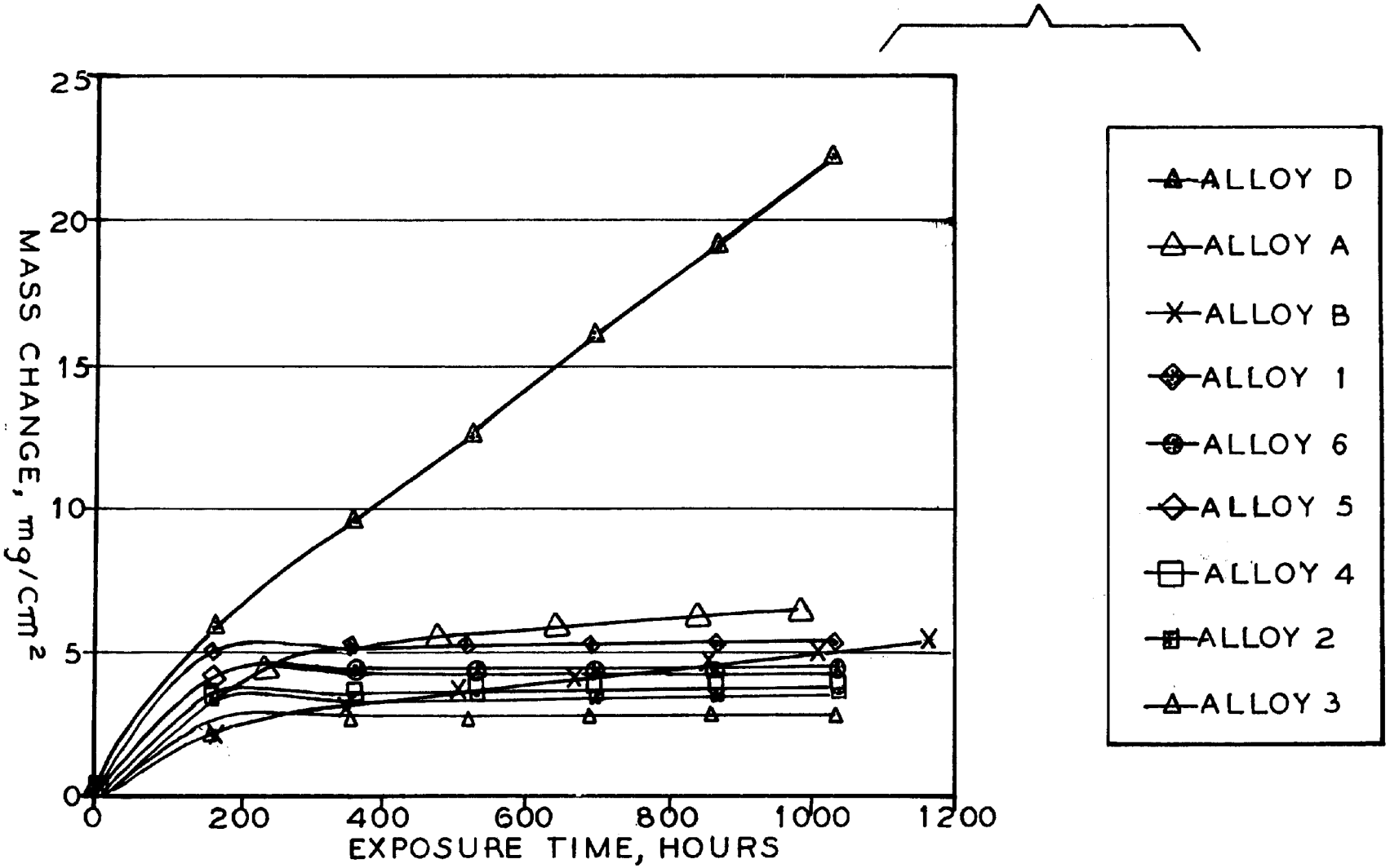
FIG. 4 compares mass change of the alloys in $H_2$ −5.5% $CH_4$ −4.5% $CO_2$ at a temperature of 1000° C.
Figure 5:
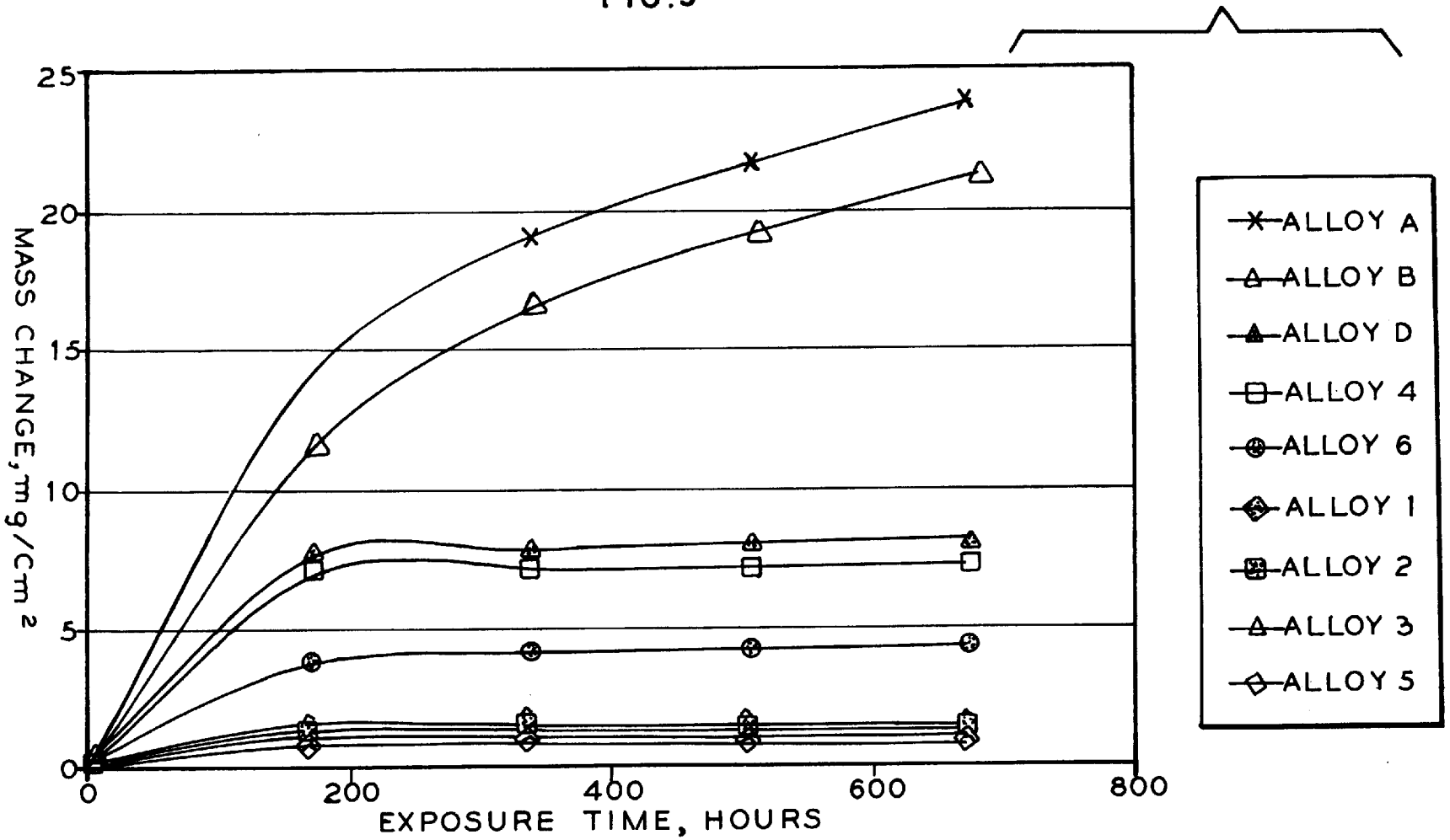
FIG. 5 compares mass change of the alloys in $H_2$ −5.5% CH4 −4.5% $CO_2$ at a temperature of 1100° C.

Carburization resistance was established for atmospheres that included: $H_2$–1% $CH_4$ at 1000° C. (1832° F.) and $H_2$–5.5%$CH_4$–4.5%$CO_2$ at 1000° C. (1832° F.) and 1100° C. (2012° F.). Carburization results for alloys 1 to 6 and the commercial alloys are shown in FIGS. 3 through 5. FIG. 3 shows alloys A and C having poor carburization at 1000° C. with $H_2$–1% $CH_4$. FIG. 4 illustrates alloy D having poor carburization resistance with $H_2$ –5.5% $CH_4$ –4.5% $CO_2$ at a temperature of 1000° C. Finally, FIG. 5 demonstrates that alloys A and B have a poor carburization resistance in $H_2$–5.5% $CH_2$ –4.5% $CO_2$ at a temperature of 1100° C. In summary, FIGS. 1 to 5 illustrate that alloys 1 to 6 have better general corrosion resistance properties than commercial alloys A to D.

Standard tensile and stress rupture test specimens were machined from the annealed room temperature tensile properties of alloys 1 through 6 along with those of selected commercial alloys from Table 2 are presented in Table 3 below.

TABLE 3

| | Room Temperature Tensile Data | | | | |
|---|---|---|---|---|---|
| | Yield Strength, | | Tensile Strength, | | Elongation |
| Alloy | MPa | ksi | MPa | ksi | Percent |
| 1 | 635 | 92.1 | 1068 | 154.9 | 30.9 |
| 2 | 625 | 90.7 | 1057 | 153.3 | 28.6 |
| 3 | 609 | 88.3 | 1012 | 146.8 | 24.4 |

TABLE 3-continued

| | Room Temperature Tensile Data | | | | |
|---|---|---|---|---|---|
| | Yield Strength, | | Tensile Strength, | | Elongation |
| Alloy | MPa | ksi | MPa | ksi | Percent |
| 4 | 588 | 85.3 | 1021 | 148.1 | 31.6 |
| 5 | 618 | 89.7 | 1053 | 152.7 | 30.4 |
| 6 | 482 | 69.9 | 910 | 132.0 | 30.5 |
| A | 290 | 42.0 | 641 | 93.0 | 52.0 |
| B | 372 | 54.0 | 807 | 117.0 | 52.0 |
| C | 338 | 49.0 | 690 | 100.0 | 46.0 |
| D | 408 | 59.2 | 843 | 122.3 | 33.9 |

Table 4 represents the 982° C. (1800° F.) or high temperature strength data for the alloys.

TA8LE 4

| | 982° C. (1800° F.) Tensile Properties | | | | |
|---|---|---|---|---|---|
| | Yield Strength | | Tensile Strength | | Elongation |
| Alloy | MPa | ksi | MPa | ksi | Percent |
| 1 | 45.0 | 6.5 | 71.7 | 10.4 | 85.3 |
| 2 | 46.0 | 6.7 | 80.0 | 11.6 | 56.2 |
| 3 | 40.0 | 5.8 | 70.3 | 10.2 | 98.4 |
| 4 | 45.0 | 6.5 | 70.3 | 10.2 | 100.2 |
| 5 | 44.0 | 6.4 | 71.7 | 10.4 | 99.3 |
| 6 | 39.0 | 5.7 | 68.3 | 9.9 | 144.2 |
| A | 69.0 | 10 | 75.8 | 11 | 100 |
| B | 96.5 | 14.0 | 186 | 27.0 | 92.0 |
| C | — | — | — | — | — |
| D | 41.0 | 6.0 | 80.7 | 11.7 | 52.6 |

The data from Tables 3 and 4 indicate that this alloy has mechanical properties acceptable for most high strengths applications at room and elevated temperatures.

Table 5 below provides the stress rupture data for the alloy.

TABLE 5

982° C. (1800° F.) Stress Rupture Properites
Specimens Annealed 1100° C. (2012° F.)/30 Minutes/Air Cooled
Test Conditions: 13.8 MPa (2 ksi)/982° C. (1800° F.)

| Alloy | Time to Failure, Hours | Elongation, Precent |
|---|---|---|
| 2 | 511 | 94 |

TABLE 5-continued

982° C. (1800° F.) Stress Rupture Properites
Specimens Annealed 1100° C. (2012° F.)/30 Minutes/Air Cooled
Test Conditions: 13.8 MPa (2 ksi)/982° C. (1800° F.)

| Alloy | Time to Failure, Hours | Elongation, Precent |
|---|---|---|
| | 758 | 158 |
| 3 | 101 | 115 |
| 4 | 210 | 138 |
| 5 | 132 | 206 |
| | 154 | 189 |
| C | 65 | — |

With regard to the stress rupture results presented in Table 5, it is observed that alloys 1 to 6 exceeded the desired minimum stress rupture life of 100 hours at 982° C. (1800° F.) and 13.8 MPa (2 ksi). Analysis of the data shows that carbon levels between 0.12 and 0.16% yield the longest stress rupture lives, but at values to 0.23 and greater alloys are satisfactory.

The data in FIGS. 1 through 5 illustrate the improvement in carburization and oxidation resistance characteristic of the alloy's compositional range. Resistance to spallation under thermal cycling conditions is attributed in great measure to the critical presence of cerium plus yttrium and optionally zirconium. In addition, the alloy's reservoir of chromium and aluminum gives the alloy a self-healing scale. The commercial alloys however, lacking adequate chromium plus aluminum, tend to internally oxidize and fail to perform similarly.

While the present patent application has been described with reference to specific embodiments, it is to be understood that modifications and variations may be resorted to without departing from the spirit and scope of the patent application, as those skilled in the art will readily understand. Such modifications and variations arc considered to be within the purview and scope of the patent application and appended claims. A given percentage range for an element can be used within a given range for the other constituents. The term "balance nickel" or "balance nickel and incidental impurities" used in referring to the nickel content of the alloy range does not exclude the presence of other elements in amounts which do not adversely affect the basic characteristics of the range of alloys, including deoxidizers and rare earth metals. It is considered that, in addition to the wrought form, this alloy range can be used in the cast condition or fabricated using powder metallurgy techniques.

We claim:

1. An alloy resistant to carburization and high temperature oxidation consisting essentially of, by weight percent, about 27 to 35 chromium, about 0 to 7 iron, about 3 to 4.4 aluminum, about 0 to 0.14 titanium, about 0.2 to 3 niobium, about 0.12 to 0.5 carbon, about 0 to 0.05 zirconium, about 0.002 to 0.05 total cerium and yttrium, about 0 to 1 manganese, about 0 to 1 silicon, about 0 to 0.5 calcium plus magnesium, about 0 to 0.1 boron and balance nickel plus incidental impurities.

2. The alloy of claim 1 containing about 28 to 34 chromium, about 0.5 to 6 iron, about 3 to 4.2 aluminum, about 0.05 to 0.3 titanium and about 0.3 to 2.5 niobium.

3. The alloy of claim 1 containing about 0.0002 to 0.3 zirconium, about 0.001 to 0.045 cerium, about 0.001 to 0.045 yttrium and total of about 0.002 to 0.05 cerium plus yttrium.

4. The alloy of claim 1 having a stress rupture life of at least 100 hours at a stress of 13.8 MPa and a temperature of 982° C.

5. An alloy resistant to carburization and high temperature oxidation consisting essentially of, by weight percent, about 52 to 67 nickel, about 28 to 34 chromium, about 0.5 to 6 iron, about 3 to 4.2 aluminum, about 0.05 to 0.3 titanium, about 0.3 to 2.5 niobium, about 0.12 to 0.4 carbon, about 0.0002 to 0.3 zirconium, about 0.001 to 0.045 cerium, about 0.001 to 0.045 yttrium, about 0.002 to 0.05 total cerium and yttrium, about 0 to 0.7 manganese, about 0 to 0.7 silicon, about 0.001 to 0.1 calcium plus magnesium, about 0 to 0.05 boron and incidental impurities.

6. The alloy of claim 5 containing about 29 to 34 chromium, about 1 to 5.5 iron, about 3 to 4 aluminum, about 0.1 to 0.3 titanium and about 0.5 to 2 niobium.

7. The alloy of claim 5 containing about 0.001 to 0.2 zirconium, about 0.0025 to 0.025 cerium, about 0.0025 to 0.025 yttrium and total of about 0.005 to 0.04 cerium plus yttrium.

8. The alloy of claim 5 having a stress rupture life of at least 100 hours at a stress of 13.8 MPa and a temperature of 982° C.

9. An alloy resistant to carburization and high temperature oxidation consisting essentially of, by weight percent. about 55 to 65 nickel, about 29 to 34 chromium, about 1 to 5.5 iron, about 3 to 4 aluminum, about 0.1 to 0.3 titanium, about 0.5 to 2 niobium, about 0.12 to 0.3 carbon, about 0.001 to 0.2 zirconium, about 0.0025 to 0.025 cerium, about 0.0025 to 0.025 yttrium, about 0.005 to 0.04 total cerium and yttrium, about 0 to 0.5 manganese, about 0 to 0.5 silicon, about 0.002 to 0.05 calcium plus magnesium, about 0 to 0.01 boron and incidental impurities.

10. The alloy of claim 9 having a stress rupture life of at least 100 hours at a stress of 13.8 MPa and a temperature of 982° C.

* * * * *